US012071755B2

(12) United States Patent
Xiang

(10) Patent No.: US 12,071,755 B2
(45) Date of Patent: Aug. 27, 2024

(54) FLOOR DRAIN STRUCTURE PREVENTING HAIR BLOCKAGE

(71) Applicant: Bingfeng Xiang, Wenzhou (CN)

(72) Inventor: Bingfeng Xiang, Wenzhou (CN)

( * ) Notice: Subject to any disclaimer, the term of this patent is extended or adjusted under 35 U.S.C. 154(b) by 105 days.

(21) Appl. No.: 17/965,473

(22) Filed: Oct. 13, 2022

(65) Prior Publication Data

US 2023/0040521 A1 Feb. 9, 2023

(51) Int. Cl.
*E03C 1/262* (2006.01)

(52) U.S. Cl.
CPC ..... *E03C 1/262* (2013.01)

(58) Field of Classification Search
CPC ..... E03C 1/262; E03F 5/041; E03F 5/0408
USPC ..... 4/287, 286, 288, 256.1, 292, 295, 652
See application file for complete search history.

(56) References Cited

U.S. PATENT DOCUMENTS

| | | | | |
|---|---|---|---|---|
| 3,959,831 | A * | 6/1976 | Hendricks | E03C 1/264 4/DIG. 14 |
| 10,570,596 | B1 * | 2/2020 | Schneck | E03C 1/26 |
| 11,066,819 | B2 * | 7/2021 | Rosario | E03C 1/262 |
| 11,391,027 | B1 * | 7/2022 | Ali | A47K 1/14 |
| 2008/0216221 | A1 * | 9/2008 | Markaj | B01D 35/10 4/289 |
| 2009/0151060 | A1 * | 6/2009 | Zubillaga | E03C 1/262 4/292 |
| 2014/0165275 | A1 * | 6/2014 | Zito | A46B 9/025 4/292 |
| 2016/0265204 | A1 * | 9/2016 | Zito | B08B 9/027 |
| 2019/0218757 | A1 * | 7/2019 | Ting | E03C 1/262 |
| 2019/0242102 | A1 * | 8/2019 | Rosario | E03C 1/262 |
| 2019/0368184 | A1 * | 12/2019 | Lo | E03C 1/264 |

FOREIGN PATENT DOCUMENTS

| | | | | |
|---|---|---|---|---|
| CN | 108842898 | A * | 11/2018 | |
| CN | 111501976 | A * | 8/2020 | |
| CN | 211285912 | U * | 8/2020 | |
| CN | 212772743 | U * | 3/2021 | |
| CN | 212772743 | U | 3/2021 | |
| CN | 111705900 | B * | 6/2021 | B01D 35/00 |
| CN | 215630529 | U * | 1/2022 | |
| CN | 215630529 | U | 1/2022 | |
| CN | 216147980 | U * | 4/2022 | |
| CN | 216147980 | U | 4/2022 | |
| CN | 116695854 | A * | 9/2023 | |

* cited by examiner

*Primary Examiner* — Lori L Baker
(74) *Attorney, Agent, or Firm* — Jeenam Park

(57) ABSTRACT

A floor drain structure includes a floor drain cover plate and a floor drain body. The floor drain body includes an upper end portion and a lower end portion, the upper end portion of the floor drain body is provided with a first mounting portion at a middle position in an upward extending manner, the floor drain cover plate is movably connected to the first mounting portion, and a hair collection structure is fixedly arranged at the lower end portion of the floor drain body. According to the present invention, the upturned floor drain cover plate can draw the floor drain body out, which is simple in operation and convenient in use; soft material will not cause collision damage to a human body; and a staggered cross bar structure of the present invention can make hairs conveniently wound, avoiding blockage of drain holes.

9 Claims, 3 Drawing Sheets

FLOOR DRAIN STRUCTURE PREVENTING HAIR BLOCKAGE

TECHNICAL FIELD

The present invention relates to the technical field of floor drains, in particular to a floor drain structure preventing hair blockage.

BACKGROUND

A floor drain refers to a drainage tool that connects the ground to a drainage pipeline system and is an important interface that connects the drainage pipeline system to the indoor ground. As an important component of a residential drainage system, its performance directly affects the quality of indoor air and is very important to control peculiar smell in the bathroom.

An existing bathroom floor drain includes a floor drain body and a floor drain cover plate, with the floor drain body being mounted below the ground, the top end of the floor drain body being flush with the ground, and the floor drain cover plate covering the floor drain body. Although the existing bathroom floor drain may achieve good effects of drainage and deodorization, hairs enter the floor drain body through the floor drain cover plate every once in a while to block the floor drain body. At this time, the floor drain body requires to be cleaned. However, the floor drain body and the floor drain cover plate of the existing bathroom floor drain are both flush with the ground, so that only the floor drain cover plate is taken away can the floor drain body be cleaned at this point. As the existing floor drain cover plate is provided with no handle and is very slippery, so that it is very inconvenient to take away the floor drain cover plate.

Now, a novel floor drain structure, which is convenient to operate and capable of preventing hairs from blocking floor drain holes is required to solve the above problems.

SUMMARY

The present invention provides a floor drain structure preventing hair blockage, which, by technically reforming the existing floor drain, solves the problem that the existing floor drain is inconvenient to open, and drain holes are easily blocked by hairs.

In order to achieve the above objective, the present invention employs the following technical solution:

a floor drain structure preventing hair blockage, including a floor drain cover plate and a floor drain body, where the floor drain body includes an upper end portion and a lower end portion, the upper end portion of the floor drain body is provided with a first mounting portion at a middle position in an upward extending manner, the floor drain cover plate is movably connected to the first mounting portion, a plurality of drain holes are uniformly defined on the upper end portion in the periphery of the first mounting portion at intervals, the floor drain cover plate is provided for closing the drain holes, a hair collection structure is fixedly arranged at the lower end portion of the floor drain body, and the floor drain cover plate and the floor drain body are made of a soft elastic material.

Preferably, a mounting hole is defined in the center of the first mounting portion, and a first mounting column is fixedly arranged in the center, relative to the first mounting portion, of the bottom surface of the floor drain cover plate, the first mounting column being provided by penetrating through the mounting hole.

Preferably, the floor drain cover plate is a hemispherical sheet, and in a closed state, the bottom surface of the floor drain cover plate is provided for closing a cavity above the drain holes, and in an opened state, the floor drain cover plate is deformed toward a direction away from the floor drain body to make the cavity above the drain holes opened.

Preferably, the first mounting portion includes several arch-shaped support bars and a cover plate mounting end, the arch-shaped support bars are provided on an upper end surface of the floor drain body and are uniformly arranged at intervals, the upper ends of the arch-shaped support bars are all fixedly connected to an outer wall of the cover plate mounting end, the mounting hole is arranged in the middle of the upper end surface of the cover plate mounting end, a pressing buffer cavity is formed between the arch-shaped support bars and the cover plate mounting end, and the floor drain cover plate is mounted at the cover plate mounting end.

Preferably, a limit boss is arranged at the lower end portion of the first mounting column, the limit boss being provided to be abutted against a lower end surface of the mounting hole.

Preferably, the drain holes are in a fan shape.

Preferably, the lower end portion of the floor drain body is in a hollow column shape, several through holes are uniformly formed on an outer side wall of the lower end portion at intervals, and the hair collection structure is fixedly arranged on the outer wall of the lower edge of the lower end portion.

Preferably, the lower end portion is a regularly polygonal column, and corners at the edges of the side wall of the lower end portion are sunken inward to form double-line grooves.

Preferably, the hair collection structure includes hair winding upright columns, which are horizontally provided and uniformly arranged on the outer wall of the lower edge of the lower end portion at intervals.

Preferably, adjacent hair winding upright columns are provided in a dislocation arrangement up and down.

The present invention has the following beneficial effects:

1) According to the present invention, a floor drain cover plate and a floor drain body are provided, and the floor drain cover plate is movably connected to the floor drain body, so that the floor drain cover plate can seal the drain holes of the floor drain body when being closed, thus playing the function of water stop; the floor drain cover plate and the floor drain body are made of the soft elastic material, and the floor drain cover plate is a hemispherical sheet, so that the floor drain cover plate can be turned up in an opposite direction by being pressed, and a space above the drain holes is released for water feeding and drainage; and the floor drain structure is convenient to use, the upturned floor drain cover plate further conveniently draws the floor drain body out, and soft material will not cause collision damage to a human body.
2) According to the present invention, the lower end portion of the floor drain body is arranged to be regularly polygonal and double-line grooves are formed on the side surface of the floor drain body, which can strengthen the winding adhesive force to hairs, and can conveniently wind hairs on the side wall of the lower end portion.
3) According to the present invention, by arranging a hair collection structure, that is a plurality of groups of hair winding upright columns which are arranged at intervals up and down, at the lower end portion of the floor drain body, the staggered cross bar structure can make hairs conveniently wound, thus preventing the drain holes from being blocked.

Listing of reference numbers: Floor Drain Cover Plate 1, First Mounting Column 11, Limit Boss 111, Cavity 1*a*, Floor Drain Body 2, Upper End Portion 21, Lower End Portion 22, Through Hole 221, Double-Line Groove 222, First Mounting Portion 23, Mounting Hole 231, Arch-shaped Support Bar 232, Cover Plate Mounting End 233, Drain Hole 24, Pressing Buffer Cavity 23*a*, Hair Collection Structure 3, and Hair Winding Upright Column 31.

DETAILED DESCRIPTION OF THE EMBODIMENTS

The specific content of the present invention is described in detail below in combination with the drawings and the embodiments.

Figure 1:
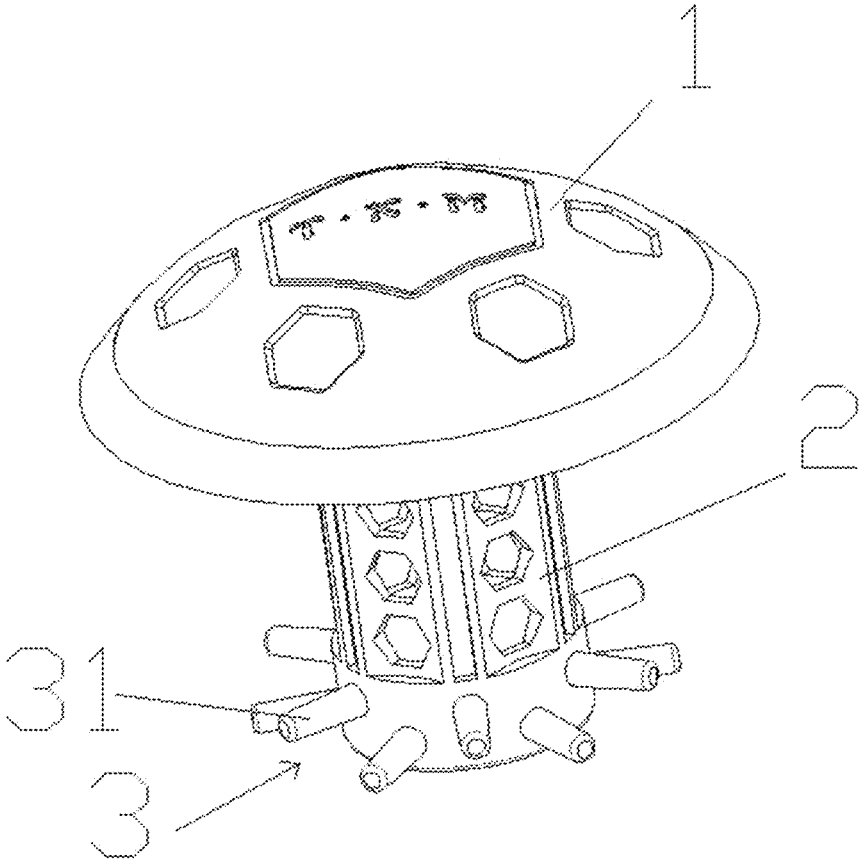
FIG. 1 is a schematic structural diagram of the present invention.
Figure 2:
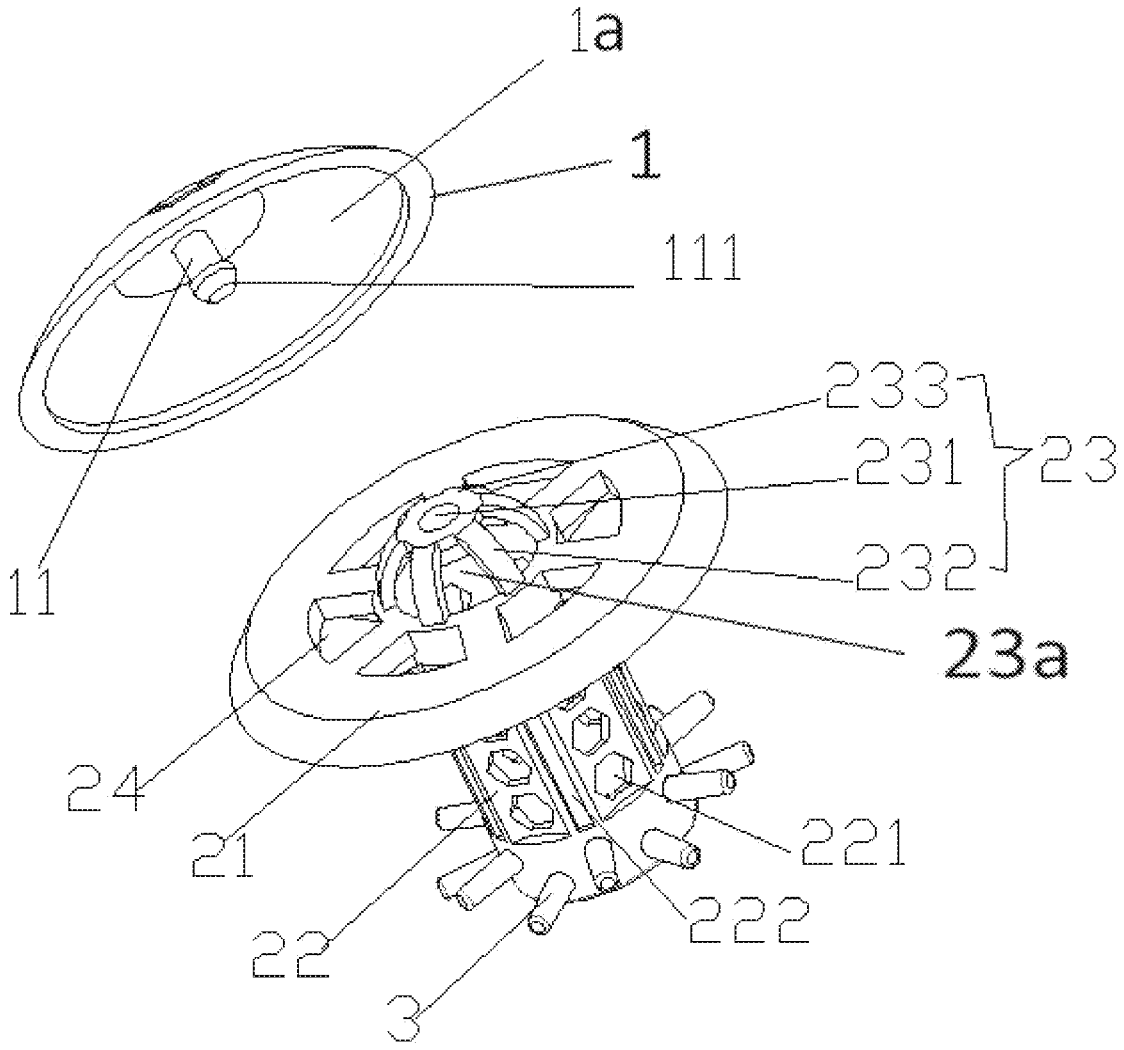
FIG. 2 is a schematic structural diagram of the floor drain cover plate and the floor drain body according to the present invention.
Figure 3:
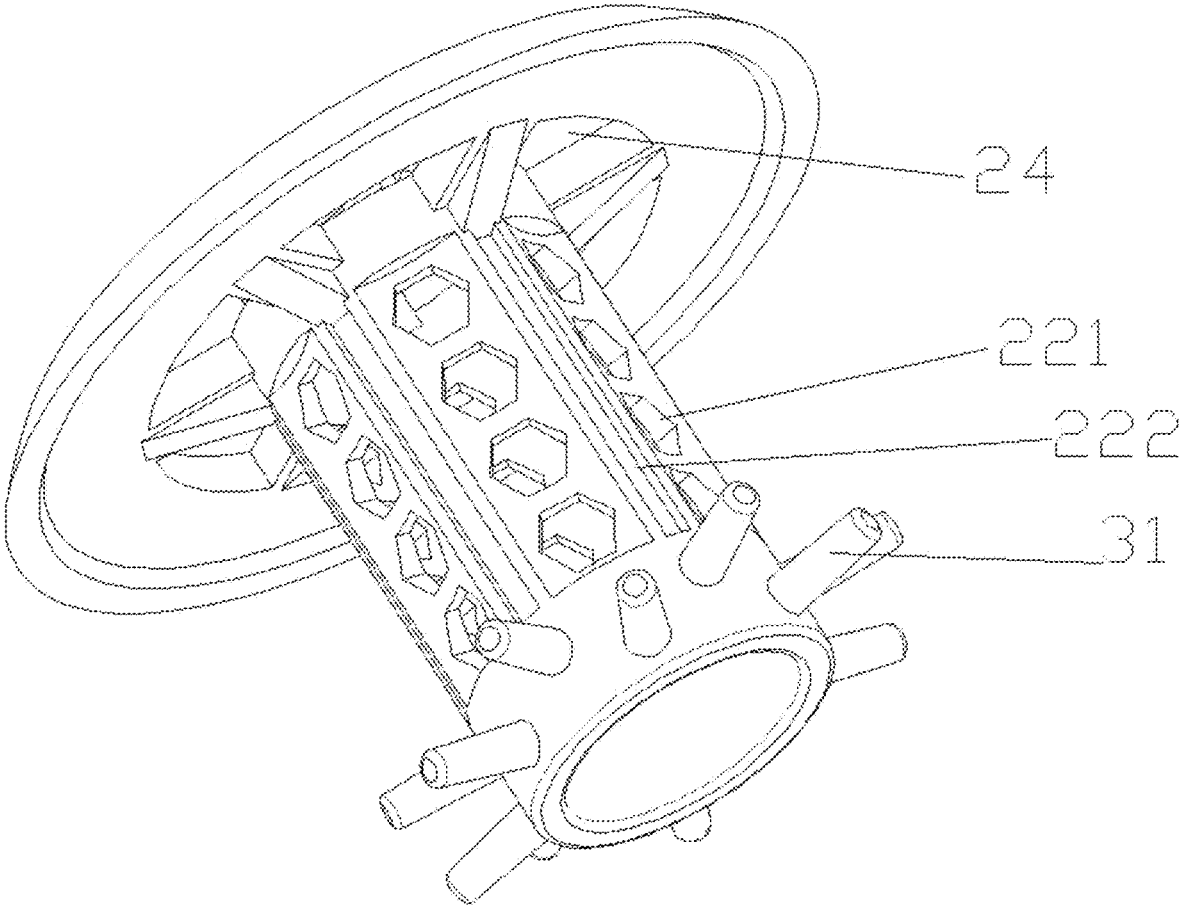
FIG. 3 is a schematic structural diagram of the lower end portion according to the present invention.

Referring to FIGS. 1-3, the present invention provides a floor drain structure preventing hair blockage, including a floor drain cover plate 1 and a floor drain body 2, where the floor drain body 2 includes an upper end portion 21 and a lower end portion 22, the upper end portion 21 of the floor drain body 2 is provided with a first mounting portion 23 at a middle position in an upward extending manner, the floor drain cover plate 1 is movably connected to the first mounting portion 23, a plurality of drain holes 24 are uniformly defined in the periphery of the first mounting portion 23 of the upper end portion 21 at intervals, the floor drain cover plate 1 is provided for closing the drain hole 24, a hair collection structure 3 is fixedly arranged at the lower end portion 22 of the floor drain body 2, and the floor drain cover plate 1 and the floor drain body 2 are made of a soft elastic material.

Further, in order to achieve that the first mounting portion 23 can connect the floor drain cover plate 1 and the floor drain body 2, a mounting hole 231 is defined in the center of the first mounting portion 23, and a first mounting column 11 is fixedly arranged in the center, relative to the first mounting portion 23, of the bottom surface of the floor drain cover plate 1, the first mounting column 11 being provided by penetrating through the mounting hole 231.

Further, in order to achieve that the floor drain cover plate 1 can be easily and simply opened and closed, the floor drain cover plate 1 is a hemispherical sheet, and; in a closed state, the bottom surface of the floor drain cover plate 1 is provided for closing a cavity 1*a* above the drain holes 24, and in an opened state, the floor drain cover plate 1 is deformed toward a direction away from a floor drain main body to make the cavity 1*a* above the drain holes 24 opened. The floor drain cover plate 1 can form a hemispherical structure with a downward opening according to its own elasticity to close the drain holes 24, or is turned upward by being pressed to form the hemispherical structure with the downward opening, so as to open the drain holes 24. The floor drain cover plate 1 can be further provided with football-shaped grains, which is more fashionable and dynamic.

Further, the first mounting portion 23 includes several arch-shaped support bars 232 and a cover plate mounting end 233, the several arch-shaped support bars 232 are provided on an upper end surface of the floor drain body 2 and are uniformly arranged at intervals, the upper ends of the arch-shaped support bars 232 are all fixedly connected to an outer wall of the cover plate mounting end 233, the mounting hole 231 is formed in the middle of the upper end surface of the cover plate mounting end 233, a pressing buffer cavity 23*a* is formed between the arch-shaped support bars 232 and the cover plate mounting end 233, and the floor drain cover plate 1 is mounted on the cover plate mounting end 233. The pressing buffer cavity 23*a* formed between the arch-shaped support bars 232 and the cover plate mounting end 233 can be deformed when the floor drain cover plate 1 is pressed, so that the floor drain cover plate 1 can be sunken from the center with the periphery turned up, and then the drain holes 24 are opened.

Further, in order to prevent the floor drain cover plate 1 from being easily departed from the floor drain main body, a limit boss 111 is arranged at the lower end portion 22 of the first mounting column 11, the limit boss 111 being provided to be abutted against the lower end surface of the mounting hole 231. With the limit effect of the limit boss 111, the floor drain main body can be taken out together when the floor drain cover plate 1 is pulled, which is convenient in use and simple in operation.

Further, the drain holes 24 are in a fan shape. The structure of the drain holes 24 is more concise and practical and is convenient in new industrial production.

Further, the lower end portion 22 of the floor drain body 2 is in a hollow column shape, several through holes 221 are uniformly formed on an outer side wall of the lower end portion 22 at intervals, and the hair collection structure 3 is fixedly arranged on the outer wall of the lower edge of the lower end portion 22. The arrangement of the through holes 221 facilitates drainage, and facilitates hairs penetrating through and being adhered to the through holes 221, thus preventing hairs from blocking the drain holes 24 by gathering together.

Further, in order to achieve that the side wall of the lower end portion 22 of the floor drain body 2 can wind hairs, the lower end portion 22 is a regularly polygonal column, and corners at the edges of the side wall of the lower end portion 22 are sunken inward to form double-line grooves 222. The lower end of the existing floor drain structure is in a cylinder shape, and the smooth side wall is inconvenient to wind with and retain hairs; while the polygonal corner edges can play an adhesion effect, and a moving space for hairs is increased with the arrangement of the double-line grooves 222, which further facilitates hair winding.

Further, the hair collection structure 3 includes hair winding upright columns 31, which are horizontally provided and uniformly arranged on the outer wall of the lower edge of the lower end portion 22 at intervals.

Further, in order to obtain better winding effect, adjacent hair winding upright columns 31 are provided in a dislocation arrangement up and down, so that hairs are easily wound on the hair winding upright columns 31 in a dislocation arrangement up and down along with a water flow.

The embodiment has the following characteristics:

1) According to the present invention, a floor drain cover plate 1 and a floor drain body 2 are provided, and the floor drain cover plate 1 is movably connected to the floor drain body 2, so that the floor drain cover plate 1 can seal the drain holes 24 of the floor drain body 2 when being closed, thus playing the function of water stop; the floor drain cover plate 1 and the floor drain body 2 are made of the soft elastic material, and the floor drain cover plate 1 is a hemispherical sheet, so that the floor drain cover plate 1 can be turned up in an opposite direction by being pressed, and a space above the drain holes 24 is released for water feeding and drainage; and the floor drain structure is convenient to use, the upturned floor drain cover plate 1 further conveniently draws the floor drain body 2 out, and soft material will not cause collision damage to a human body.

2) According to the present invention, the lower end portion 22 of the floor drain body 2 is arranged to be regularly polygonal and double-line grooves 222 are formed on the side surface of the floor drain body 2, which can strengthen the winding adhesive force to hairs, and can conveniently wind hairs on the side wall of the lower end portion 22.

3) According to the present invention, by arranging a hair collection structure 3, that is a plurality of groups of hair winding upright columns 31 which are arranged at intervals up and down, at the lower end portion 22 of the floor drain body 2, the staggered cross bar structure can make hairs conveniently wound, so as to prevent the drain holes 24 from being blocked.

At last, it should be noted that the above-mentioned embodiments are only used to illustrate the technical solutions of the present invention and shall not be construed as limitation. Although the present invention is described in detail with reference to preferred embodiments, ordinary skill in the art should understand that modifications or equivalent substitutions may be made on the technical solutions of the utility model without departing from the spirit and the scope of the technical solutions of the present invention, all of which should be contained within the scope of the claims of the present invention.

Standard parts used in the present invention can all commercially available, and special-shaped parts can be customized according to descriptions in the specification and the drawings. Specific connecting modes of various parts employ mature conventional means such as bolts, rivets and welding in the prior art; machinery, parts and devices all employ conventional models in the prior art; and circuit connection employs a conventional connection mode in the prior art, which will not be described in detail any more here.

In description of the present invention, unless otherwise expressly specified and defined, terms such as "mounted", "connected", "connecting" and "fixed" should be understood broadly, which, for example, can be a fixed connection, a detachable connection or integration; a mechanical connection or an electrical connection; a direct connection, a connection through an intermediary medium, a communication internal two elements or an interaction between two elements. The meanings of above-mentioned terms in the present invention can be understood in specific cases to those skilled in the art.

What is claimed is:

1. A floor drain structure preventing hair blockage, comprising: a floor drain cover plate and a floor drain body, wherein the floor drain body comprises an upper end portion and a lower end portion, a first mounting portion extends upward from the upper end portion of the floor drain body at a middle position, the floor drain cover plate is movably connected to the first mounting portion, a plurality of drain holes are uniformly defined on the upper end portion in the periphery of the first mounting portion at intervals, the floor drain cover plate is configured for closing the drain holes, a hair collection structure is fixedly arranged at the lower end portion of the floor drain body, and the floor drain cover plate and the floor drain body are made of a soft elastic material.

2. The floor drain structure preventing hair blockage according to claim 1, wherein a mounting hole is defined in the center of the first mounting portion, and a first mounting column is fixedly arranged in the center, relative to the first mounting portion, of the bottom surface of the floor drain cover plate, the first mounting column being configured to penetrate through the mounting hole.

3. The floor drain structure preventing hair blockage according to claim 2, wherein the floor drain cover plate is a hemispherical sheet, and in a closed state, the bottom surface of the floor drain cover plate closes a cavity above the drain holes, and in an opened state, the floor drain cover plate is deformed toward a direction away from the floor drain body to make the cavity above the drain holes opened.

4. The floor drain structure preventing hair blockage according to claim 2, wherein the first mounting portion comprises several arch-shaped support bars and a cover plate mounting end, the several arch-shaped support bars are arranged on an upper end surface of the floor drain body and are uniformly arranged at intervals, the upper ends of the arch-shaped support bars are all fixedly connected to an outer wall of the cover plate mounting end, the mounting hole is arranged in the middle of the upper end surface of the cover plate mounting end, a pressing buffer cavity is formed between the arch-shaped support bars and the cover plate mounting end, and the floor drain cover plate is mounted on the cover plate mounting end.

5. The floor drain structure preventing hair blockage according to claim 2, wherein a limit boss is arranged at the lower end portion of the first mounting column, the limit boss being configured to abut against a lower end surface of the mounting hole.

6. The floor drain structure preventing hair blockage according to claim 1, wherein the drain holes are in a fan shape.

7. The floor drain structure preventing hair blockage according to claim 1, wherein the lower end portion of the floor drain body is in a hollow column shape, several through holes are uniformly formed on an outer side wall of the lower end portion at intervals, and the hair collection structure is fixedly arranged on the outer wall of the lower edge of the lower end portion.

8. The floor drain structure preventing hair blockage according to claim 1, wherein the lower end portion is a regularly polygonal column, and corners at the edges of the side wall of the lower end portion are sunken inward to form double-line grooves.

9. The floor drain structure preventing hair blockage according to claim 7, wherein the hair collection structure comprises hair winding upright columns, which are horizontally and uniformly arranged on the outer wall of the lower edge of the lower end portion at intervals.

* * * * *